US007255347B2

(12) United States Patent
Lim

(10) Patent No.: US 7,255,347 B2
(45) Date of Patent: Aug. 14, 2007

(54) APPARATUS FOR PLAYING A GAME

(75) Inventor: Eng Hiong Clinton Lim, Singapore (SG)

(73) Assignee: Learning Brain International Pte Ltd, Singapore (SG)

( * ) Notice: Subject to any disclaimer, the term of this patent is extended or adjusted under 35 U.S.C. 154(b) by 0 days.

(21) Appl. No.: 10/502,374

(22) PCT Filed: Jan. 23, 2002

(86) PCT No.: PCT/SG02/00010

§ 371 (c)(1),
(2), (4) Date: Jul. 23, 2004

(87) PCT Pub. No.: WO03/061791

PCT Pub. Date: Jul. 31, 2003

(65) Prior Publication Data

US 2005/0054403 A1 Mar. 10, 2005

(51) Int. Cl.
*A63F 3/00* (2006.01)

(52) U.S. Cl. ..... 273/243; 273/258

(58) Field of Classification Search ..... 273/243, 273/258

See application file for complete search history.

(56) References Cited

U.S. PATENT DOCUMENTS

| | | | | |
|---|---|---|---|---|
| 1,391,333 | A * | 9/1921 | McManus | 273/249 |
| 1,410,342 | A * | 3/1922 | Newell, Jr. | 434/155 |
| 3,879,861 | A * | 4/1975 | Grantham | 434/155 |
| 4,199,145 | A * | 4/1980 | Gouraige, Jr. | 273/248 |
| 4,917,387 | A | 4/1990 | Roggero | |
| 5,071,133 | A * | 12/1991 | Smith | 273/248 |
| 6,182,966 | B1 * | 2/2001 | Wells et al. | 273/236 |
| 6,428,004 | B1 * | 8/2002 | McQuitty et al. | 273/249 |
| 6,543,771 | B1 * | 4/2003 | Kirckof | 273/248 |

FOREIGN PATENT DOCUMENTS

DE 4408583 A1 9/1995

OTHER PUBLICATIONS

International Search Report for PCT/SG/02/00010, mailed Oct. 23, 2002.

* cited by examiner

*Primary Examiner*—Vishu K. Mendiratta
(74) *Attorney, Agent, or Firm*—Conley Rose, P.C.

(57) ABSTRACT

A game includes a board (10) having a start position (30) and at least two possible finish positions (31). A number of sequential positions (35, 36, 37, 38, 39) are located between the start position (30) and the possible finish positions (31). Each player has a playing piece (21) which starts on the start position (30) and a player designating one of the finish positions (31) prior to starting the game. The game finishing when a player's playing piece (21) lands on the designated finish position (31).

18 Claims, 6 Drawing Sheets

Procrastination limits your growth. In your journey to success, procrastination is an "offence".

Fine 1st Offence $5,000
2nd Offence $10,000
3rd Offence $20,000 *( or miss 3 turns )*
4th Offence : $40,000 *( or miss 4 turns )*
5th Offence $80,000 *( or miss 5 turns )*

23

Figure 5a

Today unused is gone forever...and tomorrow may never come. In your journey to success, procrastination is an "offence".

Fine 1st Offence $5,000
2nd Offence $10,000
3rd Offence $20,000 *( or miss 3 turns )*
4th Offence $40,000 *( or miss 4 turns )*
5th Offence $80,000 *( or miss 5 turns )*

23

Figure 5b

Yesterday was history. Tomorrow is a mystery. Today is a gift. That is why it is called the present. Stop procrastinating. Value *the present*. Do it NOW!

In your journey to success, procrastination is an "offence".

Fine 1st Offence $5,000
2nd Offence $10,000
3rd Offence $20,000 *( or miss 3 turns )*
4th Offence $40,000 *( or miss 4 turns )*
5th Offence $80,000 *( or miss 5 turns )*

23

Figure 5c

Make a decision. Any decision is better than no decision. Do it NOW ! In your journey to success, procrastination is an "offence".

Fine 1st Offence $5,000
2nd Offence $10,000
3rd Offence $20,000 *( or miss 3 turns )*
4th Offence $40,000 *( or miss 4 turns )*
5th Offence $80,000 *( or miss 5 turns )*

23

Figure 5d

Your Attitude ( 1 )

Your attitude is a composite of your thoughts, feelings and actions which are expressed through your body as *RESULTS*. To change your results, you must first change your *thinking*. Life is 5% what happens to you and 95% how you respond to it !

That 95% is your *ATTITUDE !*

Collect $10,000

25

Figure 6a

Your Attitude ( 2 )

Your attitude is what you have developed and chosen. You cannot borrow someone else's attitude and neither can someone else borrow yours, or force you to change your attitude.

Only <u>you</u> can change *YOUR ATTITUDE!*

Collect $9,000

25

Figure 6b

Your Attitude ( 3 )

A small positive change or improvement in your attitude <u>today</u> will significantly affect your life one, two, three, five years from now.

Over a lifetime, this small attitudinal change that you make <u>today</u> can improve and better every aspect of your *WHOLE LIFE*.

Collect $10,000

25

Figure 6c

Child of the Universe

Say aloud :

I am the best learner,
I am most intelligent,
I am interested in everything,
I ask the most questions,
I am most creative.

*I am a wonderful child of the universe*

Collect $10,000

24

Figure 7a

Child of the Universe

Say aloud :

I am a fast learner,
I use both sides of my brain,
I have high self-esteem,
I am most imaginative,
I am most lovable.

*I am a wonderful child of the universe*

Collect $10,000

24

Figure 7b

Miracle Creation

Say aloud :

I am unique, I am amazing
I am a miracle creation and I have
a wonderful brain.

Collect $8000

24

Figure 7c

Getting Smarter

Say aloud :

Every day, in every way,
I am getting smarter and smarter.

Collect $8000

24

Figure 7d

Feedback

I do not take " failures" personally
They are just events and feedback
to tell me that I have done things
incorrectly and need to redo them
correctly. I learn from my mistakes.
Failure is part of the learning process.

Collect $10,000

24

Figure 7e

Brain Power

Say aloud :

I am now using only 1% of
my brain's capacity. And I am
already an achiever. Just you
wait and see when I use more than
just 1%. What I achieve will be
truly outstanding!

Collect $10,000

24

Figure 7f

Your Creative Brain

You are your own creative brain.
Your creative brain is not your left
brain. Neither is it your right brain.

*Your creative brain is your whole brain.*
To access your full creativity and
intellectual prowess, use both sides
of your brain.

Collect $8,000

26

Figure 8a

Daydreaming

Daydreaming is a natural and healthy
activity of your brain. We daydream all the time.
When you daydream, your brain relaxes,
processes information , makes meaning
and helps you become creative.

Movie-maker Steven Spielberg daydreams
often. That is how we are able to enjoy
blockbusters like " Star Wars', "Jurassic Park"

So continue to daydream. And night dream as well!

Collect $8,000

26

Figure 8b

New Ideas

Read every day. When you learn 2 new words
every day, you'll amass 730 new words a year.
This will provide a strong springboard in your mind
with which to latch on to other new ideas which
may crop up from any number of sources.

Your brain functions by associating, linking
and connecting new ideas.

Collect $8000

26

Figure 8c

APPARATUS FOR PLAYING A GAME

The invention relates to apparatus for playing a game.

In accordance with a first aspect of the present invention, there is provided apparatus for playing a game comprising a board marked substantially as shown in the drawings, and one or more playing pieces, the playing pieces being moved in accordance with directions in the specification.

In accordance with a second aspect of the present invention, there is provided a game comprising a board having a start position and at least two possible finish positions and a number of sequential positions located between the start position and the possible finish positions, each player having a playing piece which starts on the start position, a player designating one of the finish positions prior to starting the game, and the game finishing when a player's playing piece lands on the designated finish position.

Preferably, the sequential positions comprises a number of purchasable positions, at least one of which must be purchased by a player during the game in order for a player to win the game.

Typically, the apparatus may also comprise a set of cards which provide a player with additional instructions. Preferably, a player takes a card when the player's playing piece lands on a corresponding sequential position on the board.

Preferably, there may be more than one set of cards, each set of cards being associated with specified sequential positions of the board such that when a player's playing piece lands on a specified sequential position, the player takes a card from the set of cards corresponding to the specified position.

Typically, the sequential positions are divided into at least two sections, each section corresponding to a level of the game. Preferably, a player must complete the first level before proceeding to the second level. Typically, the start position is on the first level and the possible finishing positions are on the second level.

Typically, the game may be played by two to six players. However, it is possible that it may be played by more than six players.

Preferably, a player's playing piece proceeds round the board by moving the number of places shown by a dice (or die) rolled by the player.

Typically, the layout of the sequential positions on the board depicts the brain with the first level forming the left side of the brain and the second level forming the right side of the brain. Typically, the possible finish positions correspond to desired destiny chosen by a player. Preferably, the purchasable positions in the first level comprise the main functions of the left brain: logic; words; analysis; listing; sequence; linearity; and numbers. Preferably the purchasable positions in the second level comprise the main functions of the right brain: rhythm; colour; dimension; spatial awareness; daydreaming; imagination; and holistic awareness.

In one example of the invention, the game may be implemented using a real physical board and playing piece. However, in another example of the invention, the game may be implemented as an electronic game with the board and playing piece represented on a display device, such as a visual display unit. Where the game also includes cards and money, these may also be electronic and represented on the display device.

In accordance with a third aspect of the invention, there is provided a method of playing a game comprising providing a number of representations of functions of the brain, and acquiring a minimum number of functions in order to win the game.

Preferably, the representations include function of the left side and the right side of the brain, and functions from both sides of the brain must be acquired to win the game.

Typically, a function may be acquired by purchasing the function or by picking up a card relating to the function.

An example of apparatus for playing a game in accordance with the invention will now be described with reference to the accompanying drawings, in which.

FIGS. 5*a* to 5*d* show examples of procrastination cards;

FIGS. 6*a* to 6*c* show examples of learning cards;

FIGS. 7*a* to 7*f* show examples of self-booster cards; and

FIGS. 8*a* to 8*c* show example of synergy cards.

Figure 1:
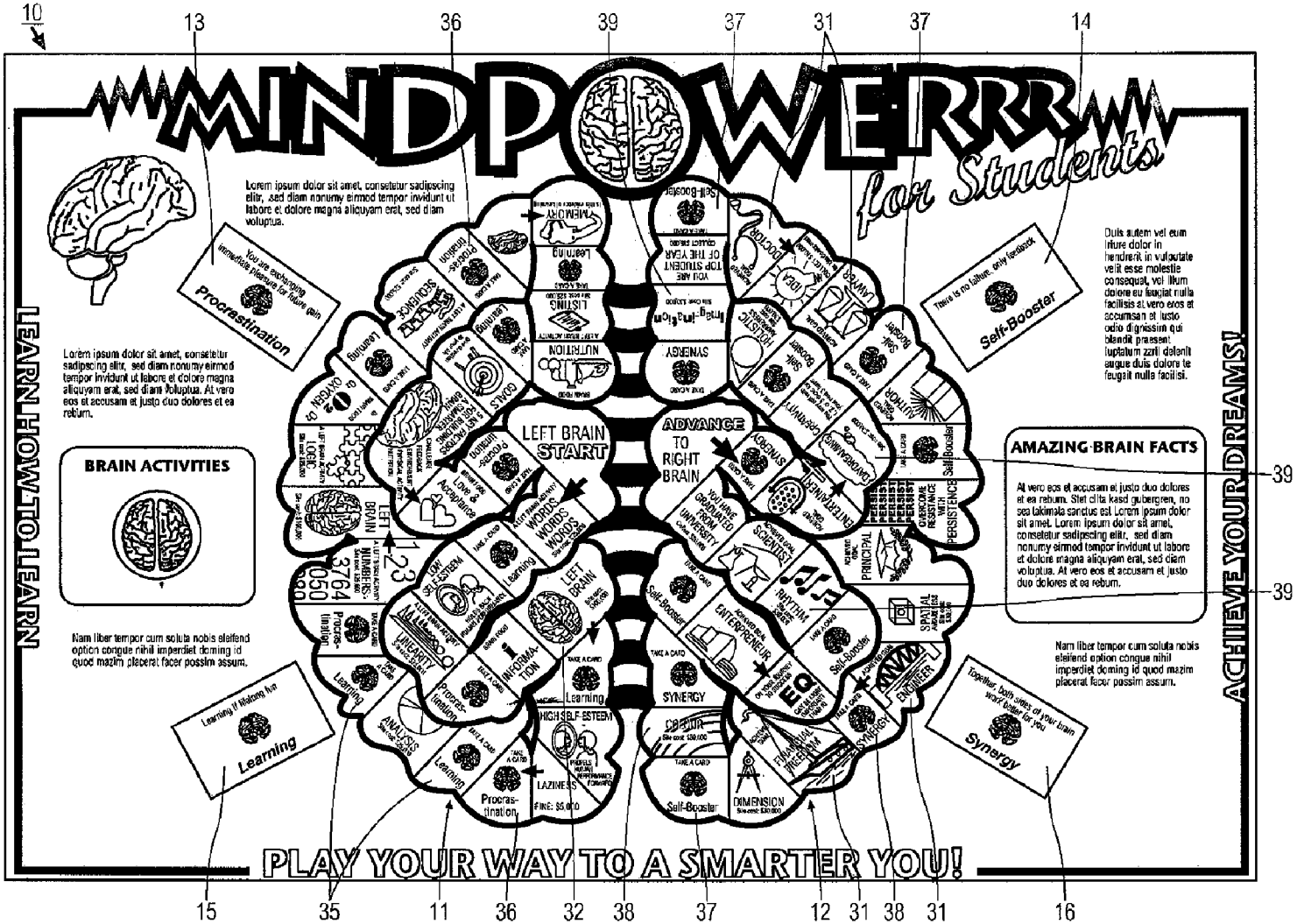
FIG. 1 is a plan view of a board.
Figure 3:
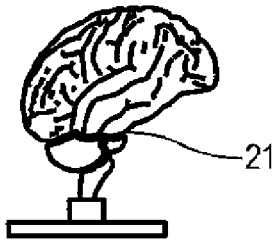
FIG. 3 shows a small brain playing piece.

FIG. 1 shows a board 10. The board includes a left brain section 11 and a right brain section 12 which each include sequential positions along which a playing piece 21 (see FIG. 3) can be moved. In addition, the board 10 has positions 13, 14, 15, 16 marked. On each portion 13–16, set of cards 23, 24, 25, 26 may be placed containing additional instructions for players playing the game. A set of procrastination cards 23 are placed on the portion 13, a set of self-booster cards 24 are placed on the portion 14, a set of learning cards 25 are placed on the portion 15 and a set of synergy cards 26 are placed on the portion 16. Examples of procrastination cards 23 are shown in FIGS. 5*a* to 5*d*, examples of learning cards 25 are shown in FIGS. 6*a* to 6*c*, examples of self-booster cards 24 are shown in FIGS. 7*a* to 7*f* and examples of synergy cards 26 are shown in FIGS. 8*a* to 8*c*.

Figure 2:
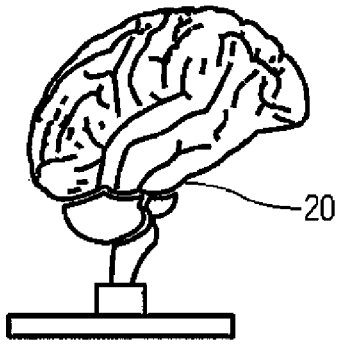
FIG. 2 shows a large brain playing piece.
Figure 4:
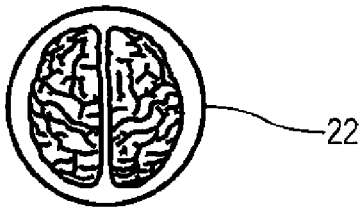
FIG. 4 shows a circular brain counter.

In order to play the game, each player is provided with a large brain playing piece 20 (see FIG. 2) and a small brain playing piece 21 (see FIG. 3) and a number of circular brain counters 22 (see FIG. 4). Each of the playing pieces 20, 21 and the counter 22 are of the same colour for each player and each player's colour is different from that of the other players. In addition, each player is provided with $500,000 of play money.

The game is played using the board 10, the playing pieces 20, 21, the circular counters 22 and the sets of cards 13, 14, 15, 16 in accordance with the rules set out below.

Rules

1. Any number, from 2–6 players can play.
2. A "banker" is appointed. A player may double-up as a "banker".
3. Each player starts with a capital of $500,000 of play money from the banker.
4. The game commences with each player deciding which ambition (or goal in life) they wish from the ambitions 31 on the right brain section 12—doctor, engineer, author, school principal, entertainer, scientist, lawyer, entrepreneur or to achieve financial freedom.

Left Brain

5. Each player chooses two brains 20, 21 of the same colour. The smaller brain is placed at "start" 30 on the left brain 11 and the other larger brain 20 at the site of the chosen ambition 31 on the right brain 12.
6. The challenge is to quickly get out of the "left brain" 11 so that you can advance to play on the "right brain" 12. To do this you must:
   i) purchase the "right brain" site 32 plus any 4 different 7 "left brain" activities 33;

or ii) acquire any 5 different 7 "left brain" activities 33 plus paying $75,000 to the banker.

7. A circular brain counter 22 of the player's colour is placed on each site 32, 33 purchased by a player.
8. A player may purchase as many "right brain" sites 32 as they wish for $100,000 per site, provided that the player stops on it each time and by paying this amount to the banker. If a player does not have sufficient funds, the player may borrow from the banker at an interest rate of 10% per annum, payable upfront (banker issues $90,000 for a $100,000 loan). Debts must be settled in full, before a player can be declared the winner.
9. A player is permitted to sell a "right brain" site 32 (if the player has purchased more than one), to any other player on a "willing-buyer-willing-seller" basis. The maximum amount a player is allowed to charge for it is $200,000.
10. A player may purchase more left brain activity sites 33 than the player requires (at $25,000 each) and then sell the additional sites to another player at a profit not exceeding 100% per site.
11. On stopping at "LEARNING" 35 or "PROCRASTINATION" 36, a player is required to take the appropriate card 25, 23 and follow its instruction before proceeding to collect the reward. Fines are to be paid in cash.

Right Brain

12. A player is permitted to play on the "right brain" 12 provided the player has fulfilled condition 6(i) or 6(ii). When 6(i) or 6(ii) are fulfilled, the small brain playing piece 21 is moved to the "Advance to Right Brain" 34.
13. On stopping at "SELF-BOOSTER" 37 or "SYNERGY" 38, a player is required to take the appropriate card 24, 26 and follow its instructions, before collecting the reward.
14. A player may purchase one or more right brain activity sites 39, and may purchase more sites than the player. Each site 39 is $30,000 each. Excess sites 39 may be sold to another player at a profit not exceeding 100% per site.
15. A circular brain counter 22 of the player's colour is placed on each site 39 purchased by that player.

Declaration of Winner

16. There are three possible ways in which a player may be declared the winner:
    i) A player is playing on the right brain and has acquired all seven activities 39:
    rhythm
    colour
    spatial awareness
    dimension
    imagination
    daydreaming
    holistic awareness;
    or ii) A player stops on the site 31 of his chosen ambition;
    or iii) A player is playing on the right brain and at a prior agreed "stop time", has amassed the most amount of assets and money.

Although, as described above the game uses a real physical board 10, playing pieces 20, 21, 22, sets of cards 23, 24, 25, 26 and play money, it is possible is that the game could be implemented electronically, for example, using a computer and software. In this case, the board, playing pieces, sets of cards, and play money may be represented on a display coupled to the computer, and the game played by entering appropriate instructions into the computer. For example, the playing pieces may be moved across the board using a mouse or key board.

The invention claimed is:

1. A gaming apparatus comprising:
a moveable playing piece for each player;
a plurality of counter pieces for each player corresponding to each player's moveable playing piece;
a non-moving playing piece for each player corresponding to each player's moveable playing piece and plurality of counter pieces;
a board, the board further comprising:
a start position for each player to position the moveable playing piece at the beginning of the game;
at least three finish positions to receive each player's non-moving playing piece prior to beginning the game; and
a schematic layout of a human brain having a plurality of sequential and interconnected positions between the start position and the finish positions, the sequential and interconnected positions including a plurality of human brain function designators; and
a plurality of cards having instructions corresponding to certain of the sequential and interconnected positions not including one of the human brain function designators; and play money to determine the location of the counter pieces placeable only on the sequential and interconnected position including one of the brain designators.

2. The gaming apparatus of claim 1 wherein the sequential and interconnected positions are divided into a first section having only left brain function designators and a second section having only right brain function designators, and the counter pieces are placeable on the positions having one of the brain function designators.

3. The gaming apparatus of claim 1 wherein the finish positions each include a different life goal designator.

4. The gaming apparatus of claim 3 wherein the non-moving playing piece is placeable on any one of the finish positions to designate a life goal for each player.

5. The gaming apparatus of claim 1 further including a die to determine movement of the moveable playing piece.

6. The gaming apparatus of claim 1 further comprising a visual display including an electronic representation of the board.

7. A gaming apparatus comprising:
a game board including a plurality of positions arranged in a schematic layout of a human brain, the plurality of positions being divided into a first section and a second section, wherein the first section further comprises:
a start position; and
a plurality of positions each representing a different left brain activity;
wherein the second section further comprises:
at least three finish positions each representing a different life goal; and
a plurality of positions each representing a different right brain activity;
a first playing piece for each player moveable to any of the plurality of positions; and
a plurality of counter pieces for each player placeable on the left and right brain activity positions; and a die to determine movement of the first piece;
and play money to determine the location of the counter pieces placeable only on the left and right brain activity positions.

8. The gaming apparatus of claim 7 further comprising a plurality of instructional card sets having corresponding positions within each of the first and second sections.

9. The gaming apparatus of claim 8 wherein four of the instructional card sets are marked with the indicia "LEARNING", "PROCRASTINATION", "SELF-BOOSTER" and "SYNERGY" and have correspondingly marked positions within the first and second sections.

10. The gaming apparatus of claim 9 wherein the first section further comprises a plurality of positions marked with the indicia "RIGHT BRAIN".

11. The gaming apparatus of claim 9 wherein the counter pieces are placeable only on the left and right brain activity positions.

12. The gaming apparatus of claim 7 further comprising a non-moving playing piece for each player placeable on any one of the finish positions to designate a life goal for each player.

13. The gaming apparatus of claim 7 wherein the life goal includes any one of doctor engineer, author, school principal, entertainer, scientist, lawyer, entrepreneur and financial freedom.

14. The gaming apparatus of claim 7 wherein the left brain activity includes any one of logic, words, analysis, listing, sequence, linearity and numbers.

15. The gaming apparatus of claim 7 wherein the right brain activity includes any one of rhythm, colour, dimension, spatial awareness, daydreaming, imagination and holistic awareness.

16. The gaming apparatus of claim 7 further comprising a visual display including an electronic representation of the game board.

17. A gaming apparatus comprising:

a game board including four positions for four different sets of instructional cards and a schematic layout of a human brain, the schematic layout of a human brain further comprising:

a left brain section of sequential and interconnected positions having a start position, a plurality of positions each representing a different left brain activity, and a plurality of positions corresponding to the sets of instructional cards; and a right brain section of sequential and interconnected positions having a plurality of positions each representing a different right brain activity, a plurality of positions corresponding to the sets of instructional cards, and at least three finish positions each representing a different life goal;

a first playing piece for each player moveable to any of the brain layout positions;

a non-moving second playing piece for each player placeable only on any one of the finish positions;

a plurality of counter pieces for each player placeable only on the left and right brain activity positions;

a die to determine movement of the first playing piece; and play money to determine the location of the counter pieces on the left and right brain activity positions.

18. The gaming apparatus of claim 17 wherein the left brain activity consists only of logic, words, analysis, listing, sequence, linearity and numbers, and the right brain activity consists only of rhythm, colour, dimension, spatial awareness, daydreaming, imagination and holistic awareness.

* * * * *